United States Patent [19]

Cardwell et al.

[11] Patent Number: 4,790,509

[45] Date of Patent: Dec. 13, 1988

[54] TUBULAR CONCRETE FORM COLLAR

[76] Inventors: William L. Cardwell, Rte. 7, Box 517, Clinton, Tenn. 37716; Charles A. Hodge, 527 Watauga Ave., Knoxville, Tenn. 37917

[21] Appl. No.: 51,391

[22] Filed: May 19, 1987

[51] Int. Cl.[4] ..... E04G 13/02

[52] U.S. Cl. ..... 249/93; 248/59; 248/65; 249/48; 249/51; 249/219.1

[58] Field of Search ..... 249/17, 48, 49, 51, 249/139, 143, 173, 219 R, 91, 93; 248/59, 63, 73, 74.4, 65

[56] References Cited

U.S. PATENT DOCUMENTS

| | | | |
|---|---|---|---|
| 155,750 | 10/1874 | Pollock et al. | 248/74.4 |
| 975,135 | 11/1910 | Kelsey et al. | 249/51 |
| 985,661 | 2/1911 | Connors | 249/48 |
| 1,000,212 | 8/1911 | Trimble | 249/48 |
| 1,000,213 | 8/1911 | Trimble | 249/48 |
| 1,199,095 | 9/1916 | Meister | 249/48 |
| 1,250,956 | 12/1917 | Bratter | 249/219 R |
| 1,250,956 | 12/1917 | Buatler | 249/48 |
| 1,272,961 | 7/1918 | Jentzer | 249/48 |
| 2,824,270 | 2/1958 | Anderson | 248/74.4 |
| 2,831,231 | 4/1958 | Toensing | 249/48 |
| 3,144,699 | 8/1964 | Williams | 249/48 |
| 3,219,308 | 11/1965 | Halstead | 249/48 |
| 3,273,837 | 9/1966 | Willert et al. | 248/59 |
| 3,591,124 | 7/1971 | Haslett | 249/48 |
| 3,672,626 | 6/1972 | Thornton | 249/48 |
| 3,990,672 | 11/1976 | Buchanan | 249/48 |
| 4,047,356 | 9/1977 | De Pirro | 249/48 |
| 4,078,752 | 3/1978 | Kindorf | 248/59 |
| 4,270,250 | 6/1981 | Schön | 248/74.4 |
| 4,429,497 | 2/1984 | Dibernardi | 248/73 |
| 4,654,612 | 3/1987 | Smith | 248/59 |

FOREIGN PATENT DOCUMENTS

| | | | |
|---|---|---|---|
| 0191480 | 8/1986 | European Pat. Off. | 248/74.4 |
| 3104342 | 8/1982 | Fed. Rep. of Germany | 248/73 |
| 3421339 | 1/1985 | Fed. Rep. of Germany | 249/48 |
| 657497 | 4/1979 | U.S.S.R. | 248/73 |

*Primary Examiner*—Jay H. Woo
*Assistant Examiner*—James C. Housel
*Attorney, Agent, or Firm*—Pitts and Brittian

[57] ABSTRACT

A collar (10) for supporting a tubular concrete form (12) for cylindrical bridge supports or the like. The collar (10) includes cooperating sections (14) and (16) dimensioned for receiving the circumference of a tubular concrete form (12). The sections can be adjusted to receive forms (12) having various diameters. In the preferred embodiment, the collar (10) includes brackets (46) suitable for being connected to a frame (60) which support the collar (10) while concrete cures in the form (12). As necessary or desired, a template (66) is mounted on the collar for positioning anchor bolts (74) and (76) at selected locations in concrete curing in the form.

7 Claims, 4 Drawing Sheets

TUBULAR CONCRETE FORM COLLAR

DESCRIPTION

1. Technical Field

This invention relates to collars for tubular concrete forms used in fabricating cylindrical pillars such as bridge supports, building columns or the like.

2. Background Art

Cylindrical concrete pillars used in conventional construction of buildings, bridges or the like, are often fabricated by pouring concrete into tubular concrete forms. Such forms are often fabricated from cardboard or other disposable material which can be peeled away from the pillar after the concrete has cured. One known cylindrical form system is sold under the trademark SONOCO.

In order to fabricate a concrete pillar using a cardboard type form, present construction techniques involve first digging a hole or preparing a supporting surface for receiving the base portion of the form. The form is then put in the hole (or on the supporting surface). A jerry-rigged collar is then fabricated by using four boards such as 2×4's to box or frame in the form. It will be noted that this type of collar engages the form at the four locations the rectangular collar contact the form and accordingly adds substantial stress to the form which can disfigure the pillar. The form is supported by building a support frame or the like, which fixes the vertical position of the jerry-rigged collar at spaced locations along the longitudinal axis of the form. Known prior art devices generally related to the field of the present invention are described in the following U.S. Pat. Nos.: 1,000,212; 1,000,213; 1,199,095; 1,250,956; 1,272,961; 3,144,699; 3,591,124; and 3,672,626.

In order to produce a concrete pillar having a desired orientation and configuration, it is necessary to hold the concrete form at a fixed and accurate position during the pouring and curing process. If slippage or misalignment of the form occurs due to improper collar support, the pillar is wasted or expensive corrective steps must be undertaken.

Accordingly, it is an object of the present invention to provide a tubular concrete collar which is adjustable such that it can fit forms having various sizes. Another object of the present invention is to provide such a collar which continuously engages the concrete form about a portion of, or all of, the circumference of the form to provide adequate support and assist in reducing slippage of the collar with respect to the form during the concrete curing process. Yet another object of the present invention is to provide such a collar which can be readily supported at a fixed vertical position along the length of the concrete form and which, if necessary or desired, includes a template which supports anchor bolts at selected locations in concrete curing in the form.

DISCLOSURE OF THE INVENTION

Other objects and advantages will be accomplished by the present invention which provides a collar which supports a tubular concrete form commonly used in fabricating concrete pillars for bridge supports, building columns or the like. The collar includes cooperating sections which are dimensioned for receiving the circumference of a tubular concrete form. Devices are provided for joining the cooperating sections of the collar together such that the collar engages the form about, at least a portion of, its circumference. In the preferred embodiment, the collar carries brackets suitable for being connected to a frame which supports the collar while concrete cures in the form. A template for anchor bolts is provided, as necessary or desired, for positioning said bolts at selected locations in the concrete during curing.

BRIEF DESCRIPTION OF THE DRAWINGS

The above mentioned features of the invention will become more clearly understood from the following detailed description of the invention read together with the drawings in which:

FIG. 1 illustrates a perspective view of the pair of tubular concrete form collars constructed in accordance with various features of the present invention and mounted on a tubular concrete form into which concrete is poured for fabricating a cylindrical pillar for bridge supports, building columns or the like.

BEST MODE FOR CARRYING OUT THE INVENTION

A collar for a tubular concrete form incorporating various features of the present invention is illustrated generally at 10 in the Figures. The lower collar is referred to as 10', and it is of like structure and configuration as that of collar 10. As shown in the Figures, the collars 10 and 10' are designed for mechanically engaging and fixing the orientation of the tubular concrete form 12. This concrete form is of conventional design and used in fabricating concrete pillars such is used as bridge supports, building columns or the like. In modern construction techniques, these forms 12 are typically fabricated from cardboard or other disposable material which can be peeled or torn away from the pillar after the concrete has cured. One known manufacturer sells disposable concrete forms under the trademark SONOCO.

Figure 2:
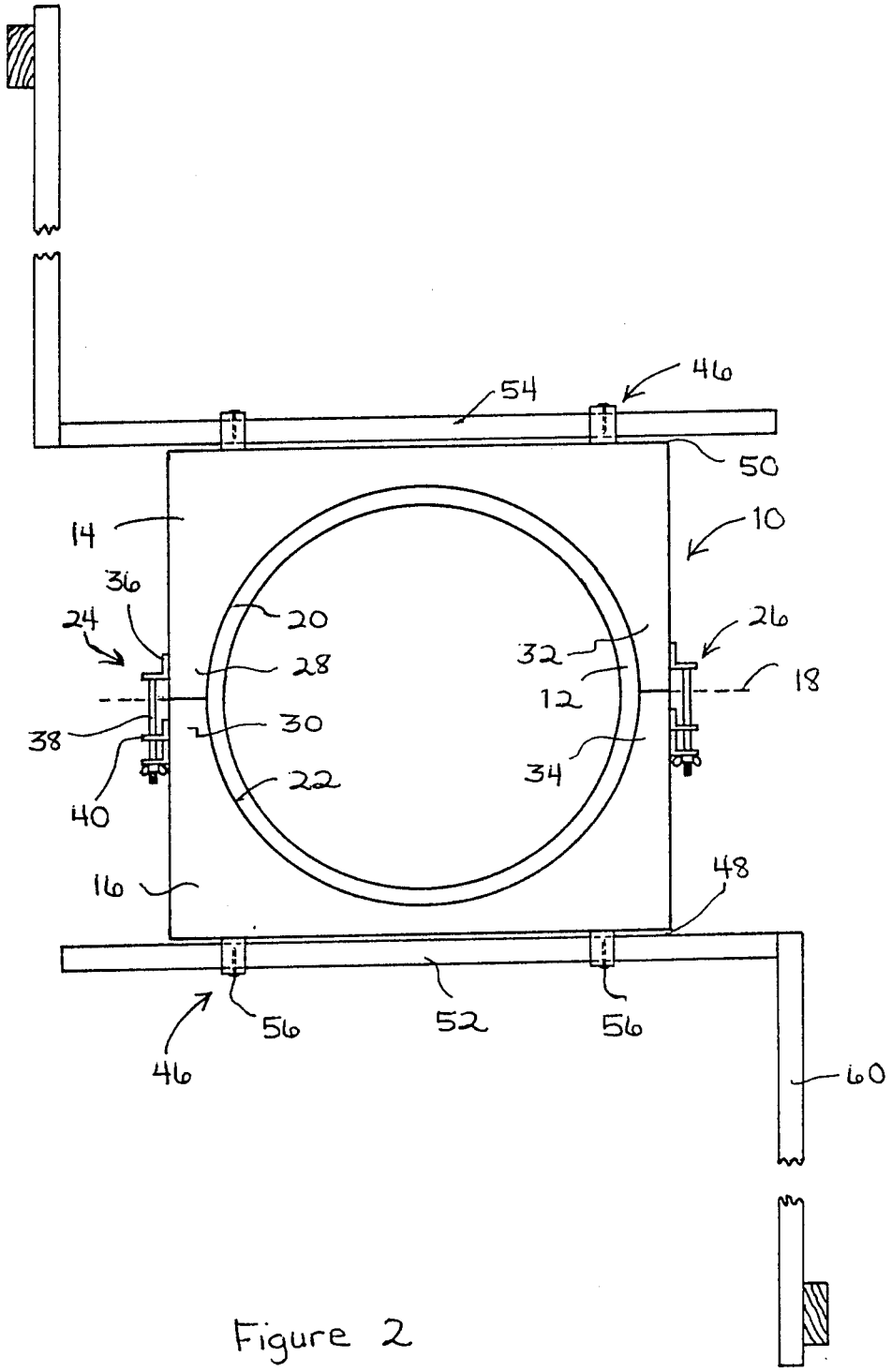
FIG. 2 illustrates a plan view of the upper collar shown in FIG. 1.

The collar 10 includes cooperating sections 14 and 16 which are dimensioned for receiving the circumference of the tubular concrete form 12 therein. More specifically, each of the sections 14 and 16 comprise a rigid or semi-rigid member having a substantially rectangular outline shown on opposite sides of the dashed line 18 in FIG. 2. The sections can be manufactured from fiberglass, aluminum or other suitable semi-rigid or rigid material. These sections 14 and 16 define semi-circular interior surfaces 20 and 22 as shown in FIG. 2. These surfaces 20 and 22 are designed to engage the tubular form 12 in diametrically opposed relationship such that the inner surfaces circumscribe the form when the collar is mounted thereon. In this connection, the interior or inner surfaces 20 and 22 provide continuous mechnical engagement about, at least a section of, the circumference of the tubular concrete form thereby reducing the stress applied to the form at any particular location as is commonly occasioned by jerry-rigging a collar from 2×4's fabricated to receive the form therein.

Means are provided for joining the cooperating sections 14 and 16 of the collar together such that the collar engages the form 12 about, at least a portion of, of its circumferences as is shown in FIG. 2. More specifically, means generally indicated at 24 and 26 serve to join the juxtaposed portions 28, 30 and 32, 34, respectively, of the collar section 14 and 16. As shown in FIG. 2, the means 24 and 26 for joining the cooperating sections of the collar 10 are substantially identical in design, and a description of one such means will suffice as a description for the other. More specifically, the means 24 is mounted on the side of section 14 and includes a bracket 36 which carries a stud 38 having an externally threaded distal end portion. This stud is designed for being received in brackets 40 mounted on the cooperating collar section 16. When the collar sections 14 and 16 are moved into position and aligned such that the stud 38 is received in suitable openings defined in the brackets 40, the collar sections can be joined by using the illustrated wing-nut which is received on the externally threaded end portion of the stud 38. This secures the juxtaposed portions 20 and 30 of collar section 14 and 16, respectively, together. In a similar manner means 26 serve to join juxtaposed portions 32 and 34 of the collar together.

In accordance with one feature of the present invention, suitable guides 42 and 44 are mounted on the juxtaposed portion of the collar such that proper alignment of the collar sections is accomplished when mounting the collar on the form 12. More specifically, the illustrated guides 42 and 44 each include studs shown by the dashed line in FIG. 4 which are mounted on section 16 of the collar. These studs are received in registering openings defined in the juxtaposed portions of section 14 of the collar such that when the collar sections are moved into position, the studs are received in the openings to establish the relative position of the sections 14 and 16 with respect to each other.

Figure 1:
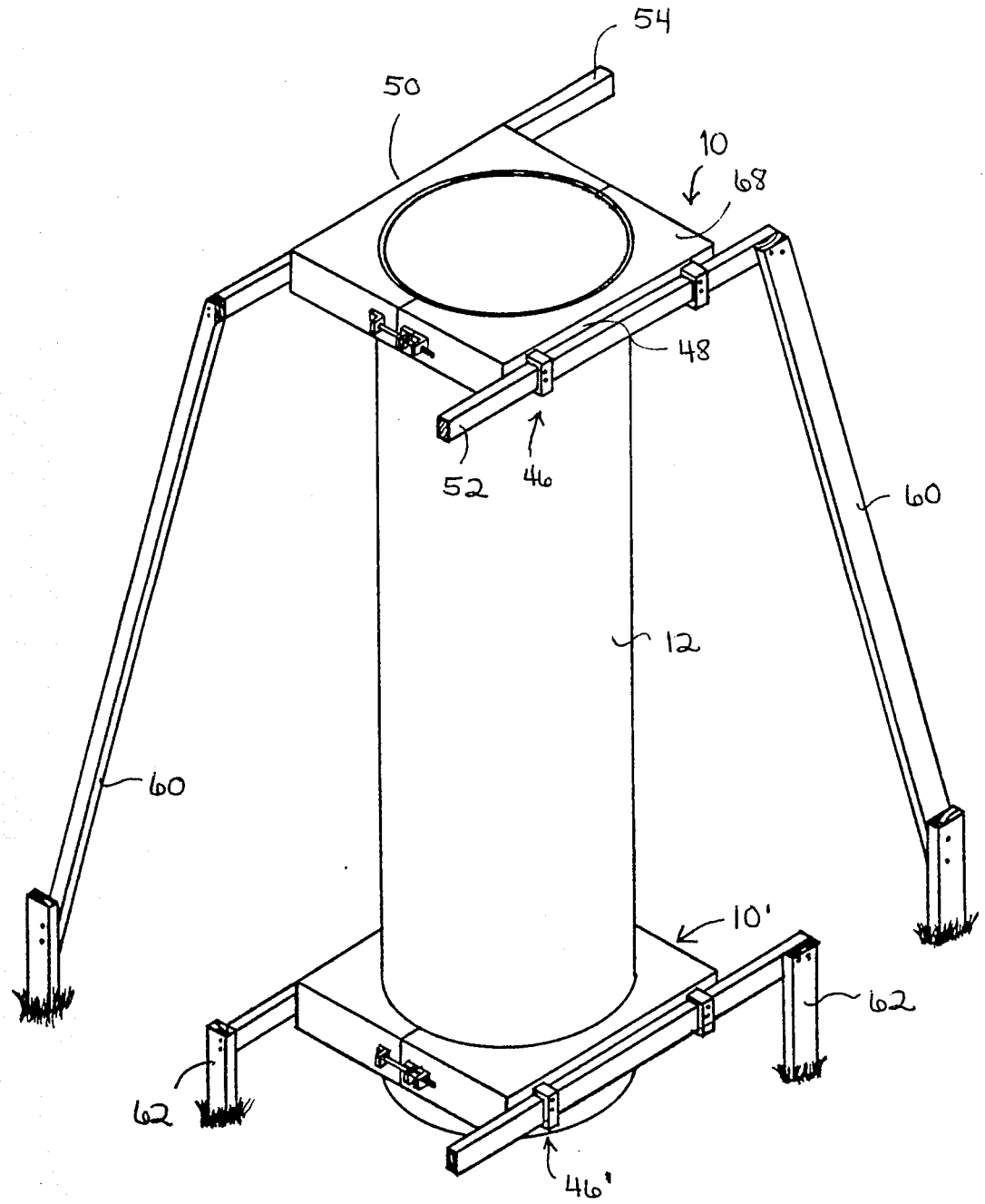

As shown in the Figures, the collars 10 and 10' are positioned at spaced vertical locations along the longitudinal axis of the form 12. In this connection, the collars combine to support the form and provide adequate mechanical engagement between the collar and the form such that slippage therebetween is prohibited. In order to fix the vertical position of the collar with respect to the form 12, brackets generally indicated at 46 are provided. These brackets 46 are mounted on the sides 48 and 50 of the collar 10 as shown in FIGS. 1 and 2. Each of the brackets define an opening which is preferably dimensioned for receiving a suitable stud or the like, such as a 2×4 therethrough. It will be noted that the brackets 46 comprise individual bracket members which are positioned at spaced locations on the sides 48 and 50 of the collar such that the openings of the bracket member register for receiving the 2×4's 52 and 54 therein as shown in FIGS. 1 and 2. Openings are provided in the bracket members as shown in FIG. 2 for receiving nails 56 therethrough to secure the 2×4's to the bracket means 46. After the 2×4's or other suitable studs 52 and 54 have been secured to the brackets 46 a suitable support frame 60 fabricated from suitable lumber or the like is connected to the studs 52 and 54 for supporting these studs and the collar 10 joined thereto. These supports frames 60 are generally fabricated in-situ, normally from lumber dimensioned to support the collar at the desired vertical locations. In a similar manner, support frame 62 is joined with the brackets 46' on the collar 10' and serves to fix the vertical position of the collar 10' with respect to the base portion of the form 12.

Figure 3:
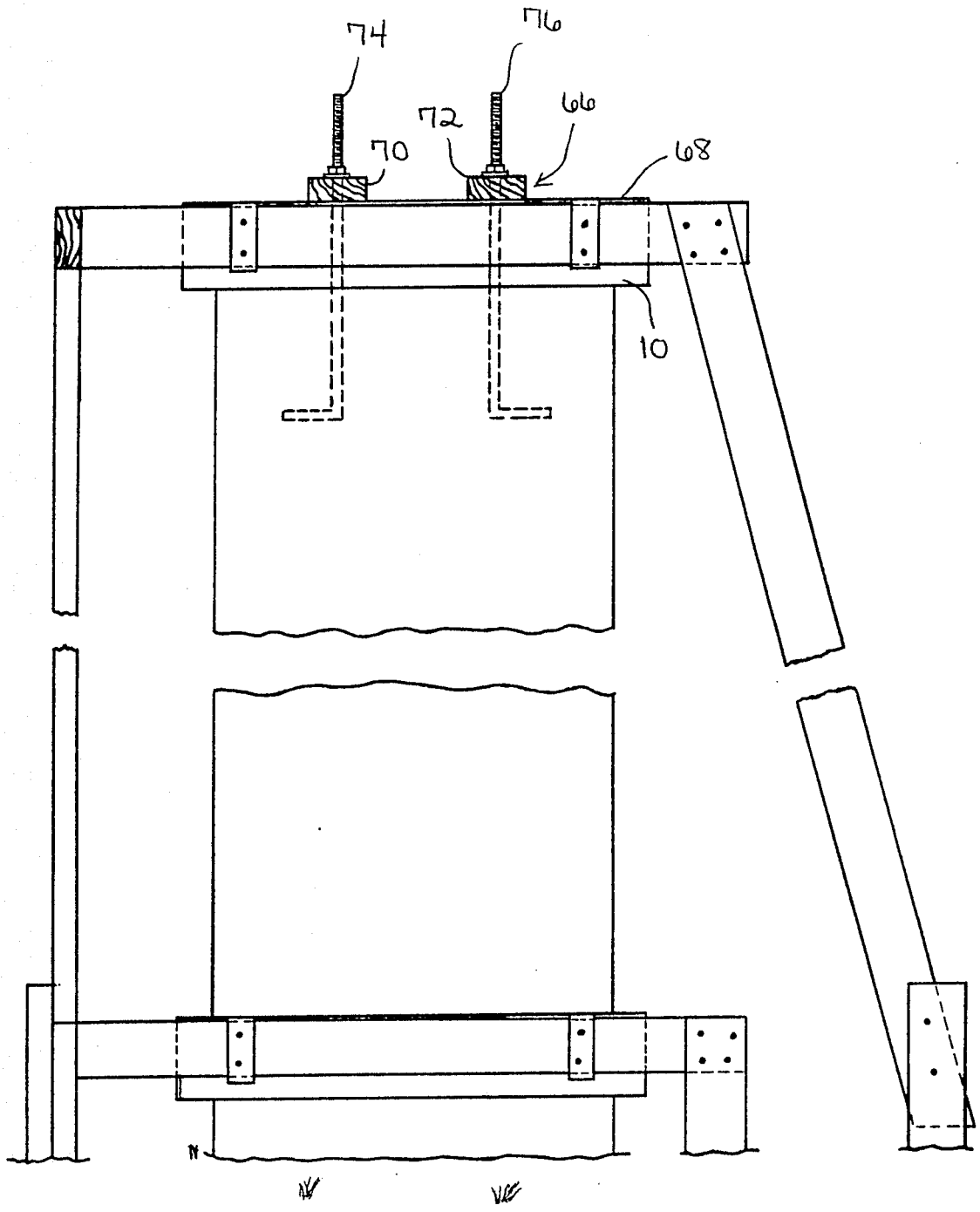
FIG. 3 illustrates a side elevation view of the collar with a portion of the concrete form broken away and depicts the anchor bolt templates supporting anchor bolts mounted in the support portion of the tubular form.
Figure 4:
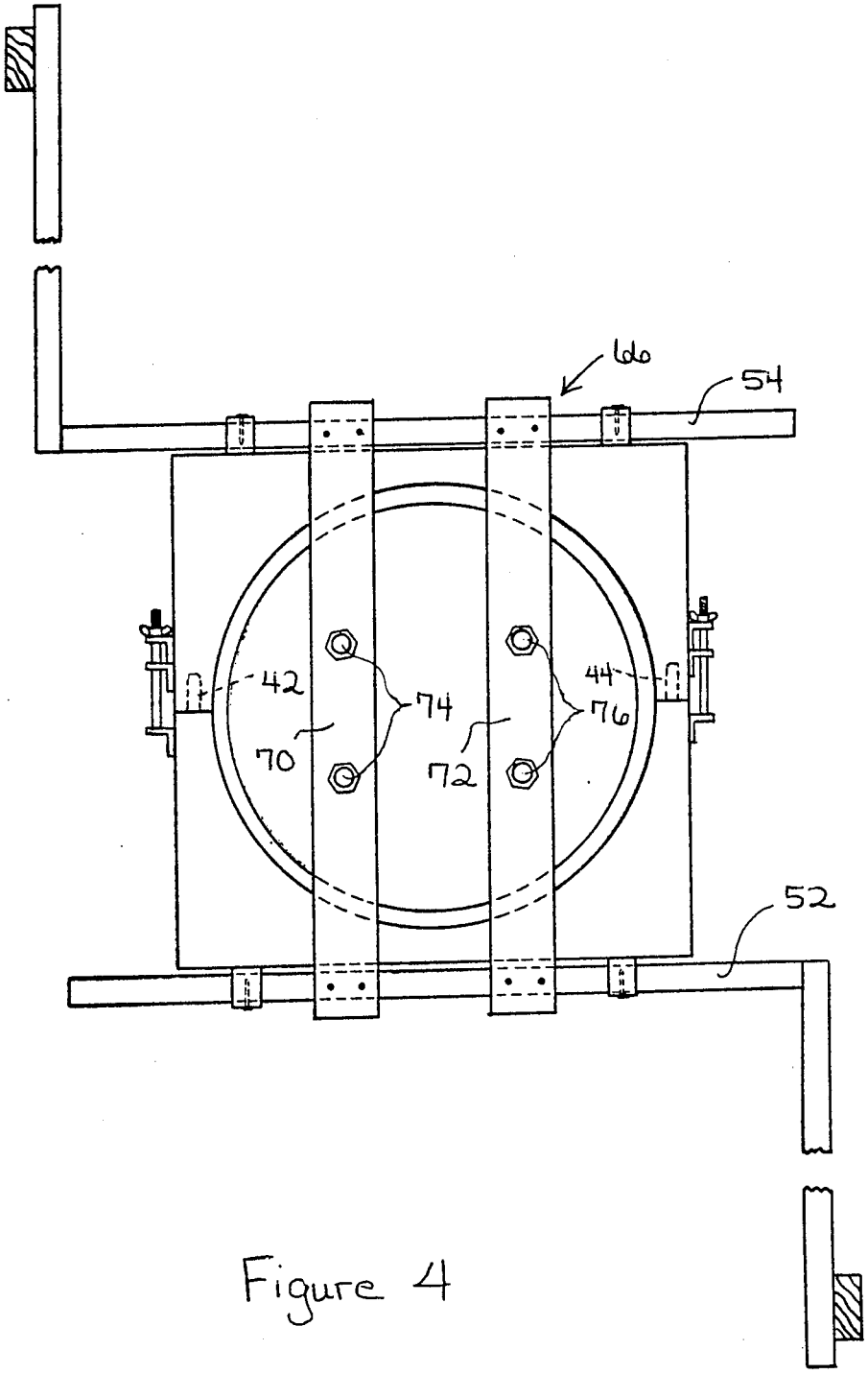
FIG. 4 illustrates a plan view of the collar used in conjunction with the anchor bolt templates shown in FIG. 3.

In accordance with another feature of the present invention, means generally indicated at 66 in FIGS. 3 and 4 serve as a template for anchor bolts which are normally mounted in the upper portion of a pillar which is used as a bridge support. The collar of the present invention is designed to readily receive the template means and, in this connection, the upper portion of the collar defines a plane 68 in the preferred embodiment upon which the template members 70 and 72 can be positioned. More specifically, when it is desirable to mount anchor bolts 74 and 76 in the upper portion of the pillar form 12 the template members 70 and 72 are layed across the surface 68 of the collar 10 and releasably secured as by being tacked at their opposite ends 40 as shown in FIG. 4 to the studs 52 and 54. These members 70 and 72 define spaced openings which receive the anchor bolts 74 and 76 therethrough. These anchor bolts are secured against downward movement by suitable nuts and/or washers which are illustrated in FIGS. 3 and 4 such that the lower portions of the anchor bolts are suspended in the concrete which cures in the form. After the curing process is complete, the template members 70 an 72 can be removed after the nuts have been removed from the external threaded end portions of the anchor bolts 74 and 76. Thus, the template means 66 can be readily used in conjunction with the upper collar 10 and serves to position anchor bolts 74 and 76 at a desired location and proper orientation during the curing process of concrete held within the form 12.

From the foregoing detailed description it will be recognized that an improved tubular concrete form collar and collar system as shown in FIG. 1 has been provided by the present invention. The illustrated collars are designed to normally be used in pairs and serve to fix the proper orientation of a tubular concrete form. The collars can be adjusted with respect to each other to assure proper positioning of the concrete form. Moreover, the present system of collars and support frames can be readily installed and removed to facilitate pillar construction.

While a preferred embodiment has been shown and described, it will be understood that there is no intent to limit the invention to such disclosure, but rather it is intended to cover all modifications and alternate constructions falling within the spirit and scope of the invention as defined in the appended claims and the equivalents thereof.

We claim:

1. A collar for supporting a tubular concrete form, comprising:

cooperating sections each having a substantially rectangular outline formed by intersection edges one edge of each section defining a semi-circular interior surface dimensioned for receiving a portion of the circumferences of said tubular concrete form therein;

means for releasably joining and cooperating sections of said collar together such that said collar engages said form around at least a substantial portion of said circumference; and bracket means carried by said cooperating sections and suitable for being connected to a temporary frame which supports said collar while concrete cures in said form, said bracket means including at least one bracket unit attached to each collar section on an edge of said section other than the edge defining said semi-circular interior surface said bracket units each provided with as first opening therethrough dimensioned for receiving a portion of said temporary frame, and a further opening intersecting said first opening for receiving a removable fastener means for releasably attaching said bracket units to said portion of said temporary frame.

2. The collar of claim 1 wherein said sections each having an upper portion which together defines a plane perpendicular to the longitudinal axis of said form when said collar is mounted thereon.

3. The collar of claim 2 including support means proximate said upper portions serving as a template for anchor bolts which are carried by said support means and suspended in concrete within said form at a selected location as said concrete cures.

4. The collar of claim 1 wherein said sections include guide means for aligning juxtaposed portions of said sections prior to joining said sections such that said collar engages said form about its circumference.

5. A collar for supporting a tubular concrete form, comprising:

cooperating sections dimensioned for receiving the circumference of a tubular concrete form therein, said sections having an upper portion which defines a plane perpendicular to the longitudinal axis of said form when said collar is mounted thereon, said cooperating sections each comprising a member having a substantially rectangular outline formed by straight edges, one edge of each section defining a semi-circular interior surface which engages said tubular form in a diametrically opposed relationship such that said interior surfaces of said sections circumscribe said form when said collar is mounted thereon;

means for joining said cooperating sections of said collar together such that said collar engages said form around at least a substantial portion of said circumference;

bracket means carried by said cooperating sections and suitable for being connected to a temporary frame which supports said collar while concrete cures in said form, said bracket means including at least one bracket unit attached to each collar section on an edge of said section other than the edge defining said semi-circular interior surface said bracket units each provided with a first opening therethrough dimensioned for receiving a portion of said temporary frame, and a further opening intersecting said first opening for receiving a removable fastener means for releasably attaching said bracket units to said portion of said temporary frame; and template means serving as a template for anchor bolts supported proximate said plane defined by said upper portions of said cooperating sections, said template means carrying said anchor bolts and suspending said bolts in concrete at a selected location within said form as said concrete cures in said form.

6. The collar of claim 5 wherein said sections include guide means for aligning juxtaposed portion of said sections prior to joining said sections such that said collar engages said form about its circumference.

7. A collar for supporting a tubular concrete form, which comprises:

a pair of cooperating sections each having an upper portion which jointly define a plane perpendicular to the longitudinal axis of said form when said collar is mounted thereon, said cooperating sections each having a substantially rectangular outline formed by straight edges, one edge of each section defining a semicircular interior surface dimensioned for closely receiving said tubular form in a diametrically opposed relationship such that said interior surfaces of said sections circumscribe said form when said collar is mounted thereon;

releasable means for joining said cooperating sections together such that said collar engages said form around at least a major portion of its circumference; and bracket means carried by said cooperating sections for being connected to a temporary wooden frame which supports said collar while concrete cures in said form, said bracket means including a pair of bracket units attached to a corresponding one of said edges of each of said sections, said bracket units each provided with a first opening therethrough, said first opening of each bracket unit of each pair being aligned for receiving therethrough a portion of said temporary frame having an orientation parallel with said edge supporting said pair of bracket units, said bracket units each provided with a further opening intersecting said first opening for receiving a removable fastener means for releasably attaching said bracket units to said frame portion.

* * * * *